US010795392B1

(12) United States Patent
Wu et al.

(10) Patent No.: US 10,795,392 B1
(45) Date of Patent: Oct. 6, 2020

(54) OUTPUT STAGE CIRCUIT AND RELATED VOLTAGE REGULATOR

(71) Applicant: NOVATEK Microelectronics Corp., Hsin-Chu (TW)

(72) Inventors: Chung-Jui Wu, Tainan (TW); Yu-Jen Yen, Tainan (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 0 days.

(21) Appl. No.: 16/384,965

(22) Filed: Apr. 16, 2019

(51) Int. Cl.
*G05F 1/575* (2006.01)
*G05F 1/595* (2006.01)

(52) U.S. Cl.
CPC ..... *G05F 1/575* (2013.01); *G05F 1/595* (2013.01)

(58) Field of Classification Search
CPC ... G05F 1/46; G05F 1/461; G05F 1/56; G05F 1/575; G05F 1/59; G05F 1/595
See application file for complete search history.

(56) References Cited

U.S. PATENT DOCUMENTS 4,486,703 A * 12/1984 Henrich ..... F02D 41/3005 323/222
6,703,813 B1 * 3/2004 Vladislav ..... G05F 1/575 323/270
7,570,088 B1 * 8/2009 Ku ..... H03K 19/00315 327/112
9,778,672 B1 * 10/2017 Gao ..... G05F 1/575
9,921,594 B1 * 3/2018 Kovac ..... G05F 1/565
9,958,889 B2 * 5/2018 Pons ..... H02J 7/0068
10,416,696 B2 * 9/2019 Chen ..... G05F 1/595
2008/0129377 A1 * 6/2008 You ..... G05F 1/56 330/10
2008/0224632 A1 * 9/2008 Noda ..... H05B 33/0812 315/291
2009/0278518 A1 * 11/2009 Takagi ..... G05F 1/56 323/282
2014/0117952 A1 * 5/2014 Li ..... G05F 1/565 323/271
2017/0271195 A1 * 9/2017 Hoyerby ..... H01L 21/823892
2018/0151240 A1 * 5/2018 Zhou ..... G11C 7/24
2018/0158533 A1 * 6/2018 Zhou ..... G11C 17/18
2018/0234095 A1 * 8/2018 Balteanu ..... H03K 17/693
2019/0295672 A1 * 9/2019 Zhou ..... G11C 17/18

* cited by examiner

*Primary Examiner* — Adolf D Berhane
(74) *Attorney, Agent, or Firm* — Winston Hsu

(57) ABSTRACT

An output stage circuit of a voltage regulator includes a first output transistor, a first voltage generator and a first stack transistor. The first stack transistor is coupled between the first output transistor and an output terminal of the voltage regulator, and includes a first terminal, a second terminal and a third terminal. The first terminal is coupled to the output terminal of the voltage regulator. The second terminal is coupled to the first output transistor. The third terminal is coupled to the first voltage generator.

24 Claims, 6 Drawing Sheets

OUTPUT STAGE CIRCUIT AND RELATED VOLTAGE REGULATOR

BACKGROUND OF THE INVENTION

I. Field of the Invention

The present invention relates to an output stage circuit of a voltage regulator and the related voltage regulator, and more particularly, to an output stage circuit implemented with middle voltage devices and its related voltage regulator.

2. Description of the Prior Art

The push-pull voltage regulator is a low dropout (LDO) regulator with both source and sink capabilities. More specifically, the push-pull voltage may have a PMOS output transistor operated as a current source and an NMOS output transistor providing a current sink path, so as to provide push-pull regulation.

When the push-pull voltage regulator operates in a high voltage domain, i.e., receiving a high power supply voltage, the output transistors should be high voltage devices having a withstand voltage conforming to the power supply voltage. If the voltage regulator needs to be implemented with middle voltage devices, the output voltage range of the voltage regulator is limited; otherwise, the cross voltage of an output transistor may exceed the output transistor's withstand voltage. Thus, there is a need for improvement over the prior art.

SUMMARY OF THE INVENTION

It is therefore an objective of the present invention to provide a novel voltage regulator, which is capable of realizing a large output voltage range only with the usage of middle voltage devices and/or low voltage devices, so as to reduce the chip area and circuit costs.

An embodiment of the present invention discloses an output stage circuit of a voltage regulator, which comprises a first output transistor, a first voltage generator and a first stack transistor. The first stack transistor is coupled between the first output transistor and an output terminal of the voltage regulator, and comprises a first terminal, a second terminal and a third terminal. The first terminal is coupled to the output terminal of the voltage regulator. The second terminal is coupled to the first output transistor. The third terminal is coupled to the first voltage generator.

Another embodiment of the present invention discloses a voltage regulator, which comprises an amplifier, a control circuit, a level shifter and an output stage circuit. The control circuit is coupled to the amplifier. The level shifter is coupled to the control circuit. The output stage circuit is coupled to the level shifter, and comprises a first output transistor, a first voltage generator and a first stack transistor. The first stack transistor is coupled between the first output transistor and an output terminal of the voltage regulator, and comprises a first terminal, a second terminal and a third terminal. The first terminal is coupled to the output terminal of the voltage regulator. The second terminal is coupled to the first output transistor. The third terminal is coupled to the first voltage generator.

Another embodiment of the present invention discloses an output stage circuit of a push-pull voltage regulator, which comprises a high-side output transistor, a low-side output transistor, a first voltage generator and a first stack transistor. The first stack transistor is coupled between the high-side output transistor and an output terminal of the push-pull voltage regulator, and comprises a first terminal, a second terminal and a third terminal. The first terminal is coupled to the output terminal of the push-pull voltage regulator. The second terminal is coupled to the high-side output transistor. The third terminal is coupled to the first voltage generator.

Another embodiment of the present invention discloses an output stage circuit of a push-pull voltage regulator, which comprises a high-side output transistor, a low-side output transistor, a first voltage generator and a first stack transistor. The first stack transistor is coupled between the low-side output transistor and an output terminal of the push-pull voltage regulator, and comprises a first terminal, a second terminal and a third terminal. The first terminal is coupled to the output terminal of the push-pull voltage regulator. The second terminal is coupled to the low-side output transistor. The third terminal is coupled to the first voltage generator.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
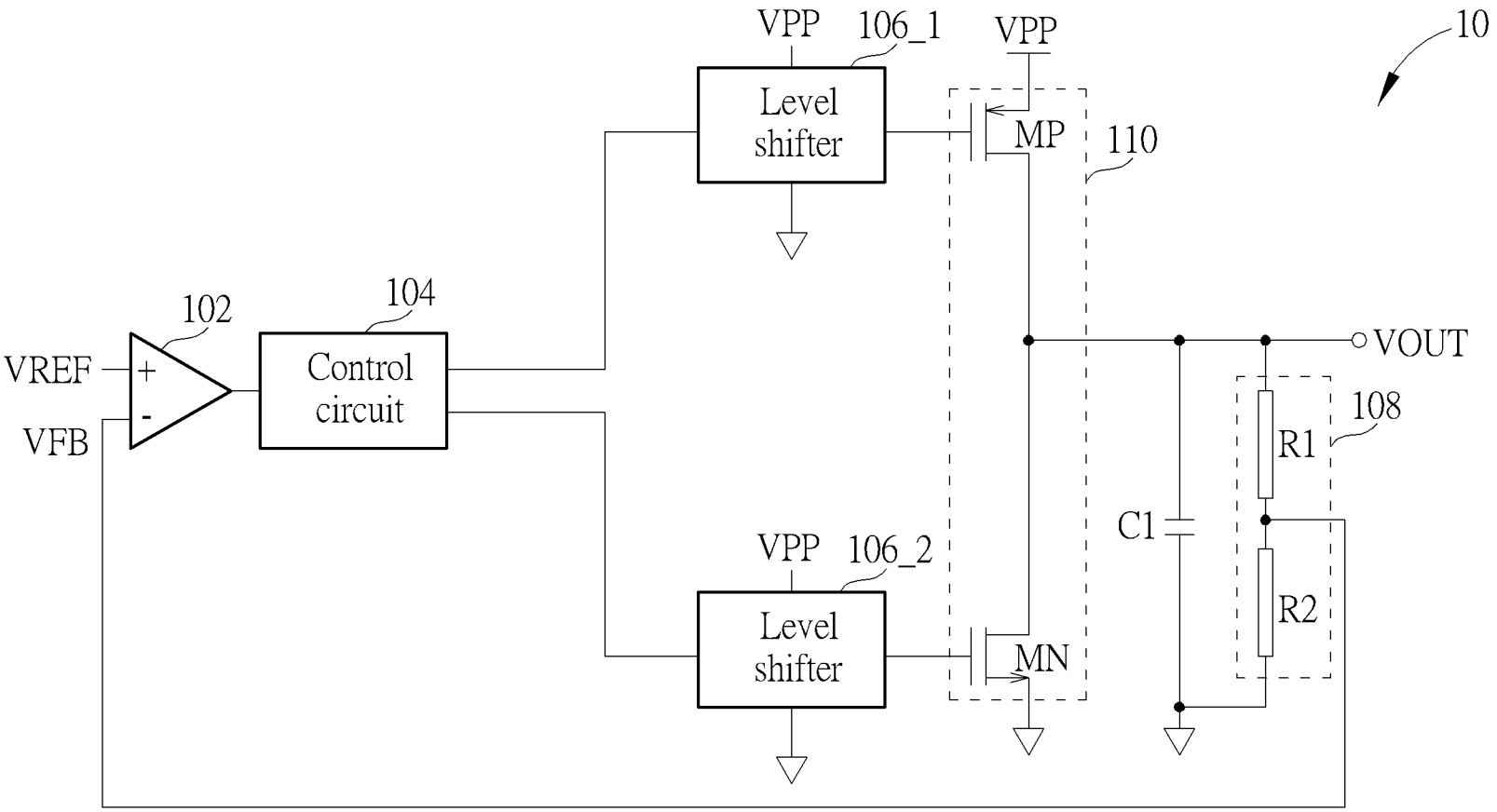
FIG. 1 is a schematic diagram of a general voltage regulator.

Please refer to FIG. 1, which is a schematic diagram of a general voltage regulator 10. As shown in FIG. 1, the voltage regulator 10 includes an amplifier 102, a control circuit 104, level shifters 106_1 and 106_2, a voltage divider 108 and an output stage circuit 110. The amplifier 102 receives a feedback voltage VFB from the output terminal of the voltage regulator 10 (via the voltage divider 108), and also receives a reference voltage VREF. The amplifier 102 and the control circuit 104 provide gate control signals for the output transistors MP and MN in the output stage circuit 110, to control the output transistors MP and MN to supply currents. In this example, the voltage regulator 10 is a push-pull voltage regulator, and thus the output stage circuit 110 includes the high-side output transistor MP coupled between the output terminal and the power supply terminal and a low-side output transistor MN coupled between the output terminal and the ground terminal, for providing source currents or sink currents, respectively. In general, the amplifier 102 and the control circuit 104 operate in a low voltage domain such as the core voltage domain, while the output stage circuit 110 operates in a higher voltage domain, e.g., receiving a high power supply voltage VPP, for supplying a higher output voltage VOUT; hence, the level shifters 106_1 and 106_2 are coupled between the control circuit 104 and the output stage circuit 110, for shifting the voltage level of the gate control signals for the output transistors MP and MN in the output stage circuit 110. In this example, the level shifters 106_1 and 106_2 operate in the high voltage domain, and thus should be implemented with high voltage devices which are capable of withstanding the high power supply voltage VPP.

In addition, the voltage divider 108, which may be composed of a resistor ladder having resistors R1 and R2, is coupled between the output terminal of the voltage regulator 10 and the amplifier 102, to generate the feedback voltage VFB based on the output voltage VOUT of the voltage regulator 10. A capacitor C1, which may be included in the voltage regulator 10 or disposed alone, is coupled to the output terminal of the voltage regulator 10, in order to improve the stability of the voltage regulator 10.

As shown in FIG. 1, if the output transistors MP and MN are high voltage devices, the voltage regulator 10 may provide a large output voltage range from the ground voltage 0V to the power supply voltage VPP. However, in order to reduce the circuit costs, it is preferable to implement the circuits of the voltage regulator 10 with middle voltage devices having a withstand voltage lower than the high voltage devices. In such a situation, the output voltage VOUT may be limited to a small range under the limitation of cross voltages of the output transistors MP and MN.

Figure 2:
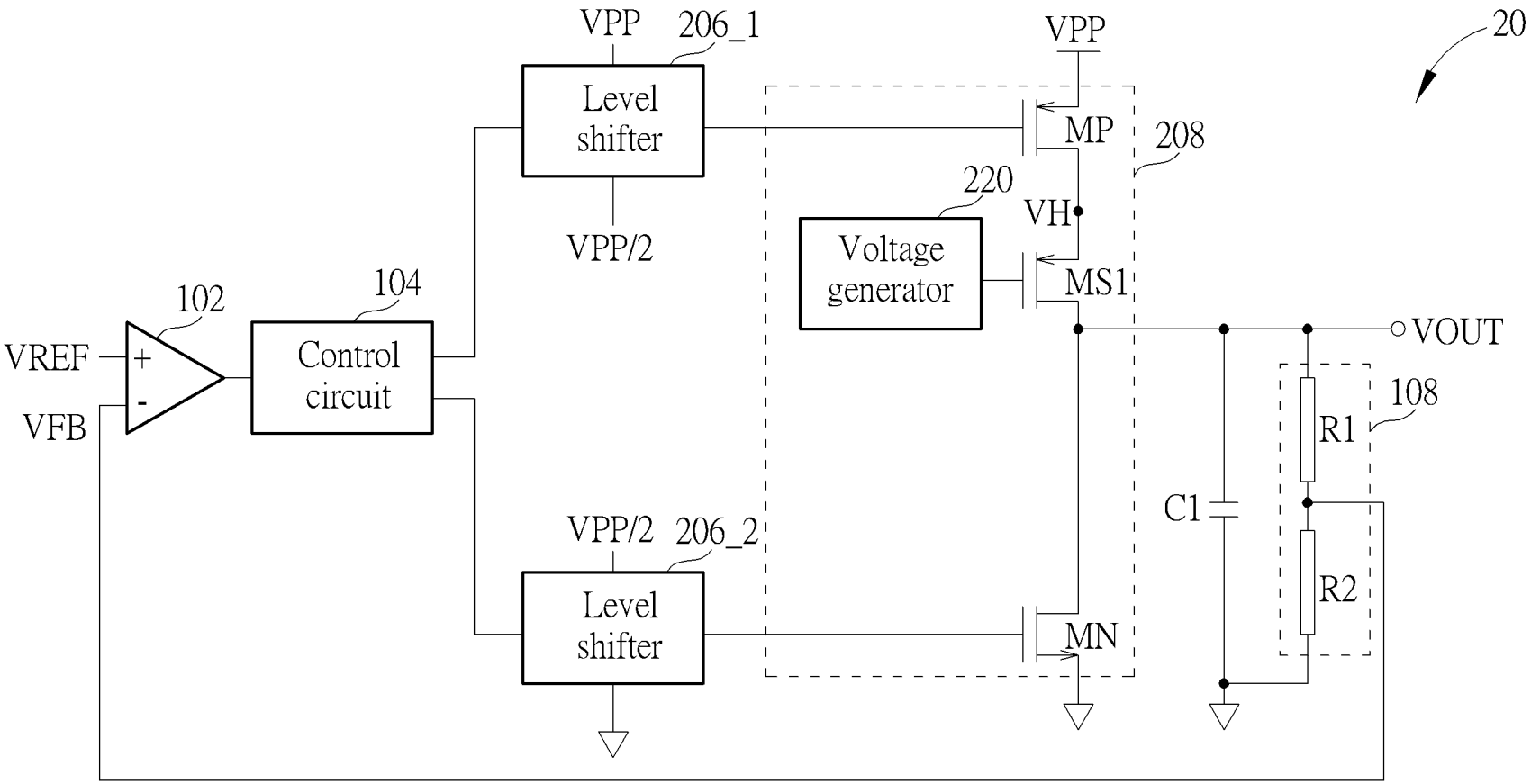
FIG. 2 is a schematic diagram of a voltage regulator according to an embodiment of the present invention.

Please refer to FIG. 2, which is a schematic diagram of a voltage regulator 20 according to an embodiment of the present invention. The circuit structure of the voltage regulator 20 is similar to the circuit structure of the voltage regulator 10, so circuit elements and signals with similar functions are denoted by the same symbols. The voltage regulator 20 and the voltage regulator 10 differ in the structure of the output stage circuit. In detail, the output stage circuit 208 of the voltage regulator 20 further includes a voltage generator 220 and a stack transistor MS1 coupled between the high-side output transistor MP and the output terminal of the voltage regulator 20.

More specifically, the high-side output transistor MP may be a PMOS transistor and the low-side output transistor MN may be an NMOS transistor. The stack transistor MS1, which is coupled between the high-side output transistor MP and the output terminal of the voltage regulator 20, is also a PMOS transistor. As for the stack transistor MS1, the drain terminal is coupled to the output terminal of the voltage regulator 20, the source terminal is coupled to the high-side output transistor MP, and the gate terminal is coupled to the voltage generator 220.

In the output stage circuit 208 of the voltage regulator 20, the output transistors MP and MN and the stack transistor MS1 are middle voltage devices, while the output stage circuit 208 still operates in the high power supply voltage VPP that may be greater than the withstand voltage of the middle voltage devices. With the implementation of the stack transistor MS1, the voltage VH may be pushed to a higher value even if the output voltage VOUT is lower. This clamps the drain-to-source voltage of the output transistor MP to be within its withstand voltage, i.e., the withstand voltage of the middle voltage device, so as to prevent overstress appearing on the output transistor MP. In addition, the voltage generator 220 may output a proper gate control voltage to the stack transistor MS1, to turn on the stack transistor MS1 and allow the drain-to-source voltage of the stack transistor MS1 to be within its withstand voltage, so as to prevent overstress appearing on the stack transistor MS1.

In an embodiment, the voltage generator 220 may output the gate control voltage to the stack transistor MS1 according to the output voltage VOUT of the voltage regulator 20. For example, the voltage generator 220 may be configured with several candidate voltages that may be used as its output voltage, and the gate control voltage may be selected from the candidate voltages via the control of registers or by other methods. As a voltage source for a circuit system, the voltage regulator 20 may output a constant voltage value; that is, the output voltage VOUT is predetermined and fixed when the voltage regulator 20 is in use. Therefore, the proper value of the gate control voltage for the stack transistor MS1 may also be predetermined based on the output voltage VOUT. For example, when the output voltage VOUT is higher, a candidate voltage with a higher value may be selected as the gate control voltage to be received by the stack transistor MS1; when the output voltage VOUT is lower, another candidate voltage with a lower value may be selected as the gate control voltage to be received by the stack transistor MS1, so as to achieve proper cross voltages of the output transistor MP and the stack transistor MS1.

Please note that the voltage regulator 20 shown in FIG. 2 and the voltage regulator 10 shown in FIG. 1 have another difference. The level shifters 206_1 and 206_2 of the voltage regulator 20 are different from the level shifters 106_1 and 106_2 of the voltage regulator 10. In detail, the level shifters 206_1 and 206_2 apply the middle voltage devices instead of high voltage devices, to avoid the usage of high voltage process in the voltage regulator 20. In this embodiment, the high power supply voltage VPP is divided to generate the voltage VPP/2, e.g., via a resistor ladder. The high-side level shifter 206_1 may receive the voltages VPP and VPP/2 as its power and ground voltages, and the low-side level shifter 206_2 may receive the voltages VPP/2 and 0V as its power and ground voltages, allowing the usage of middle voltage devices.

Figure 3:
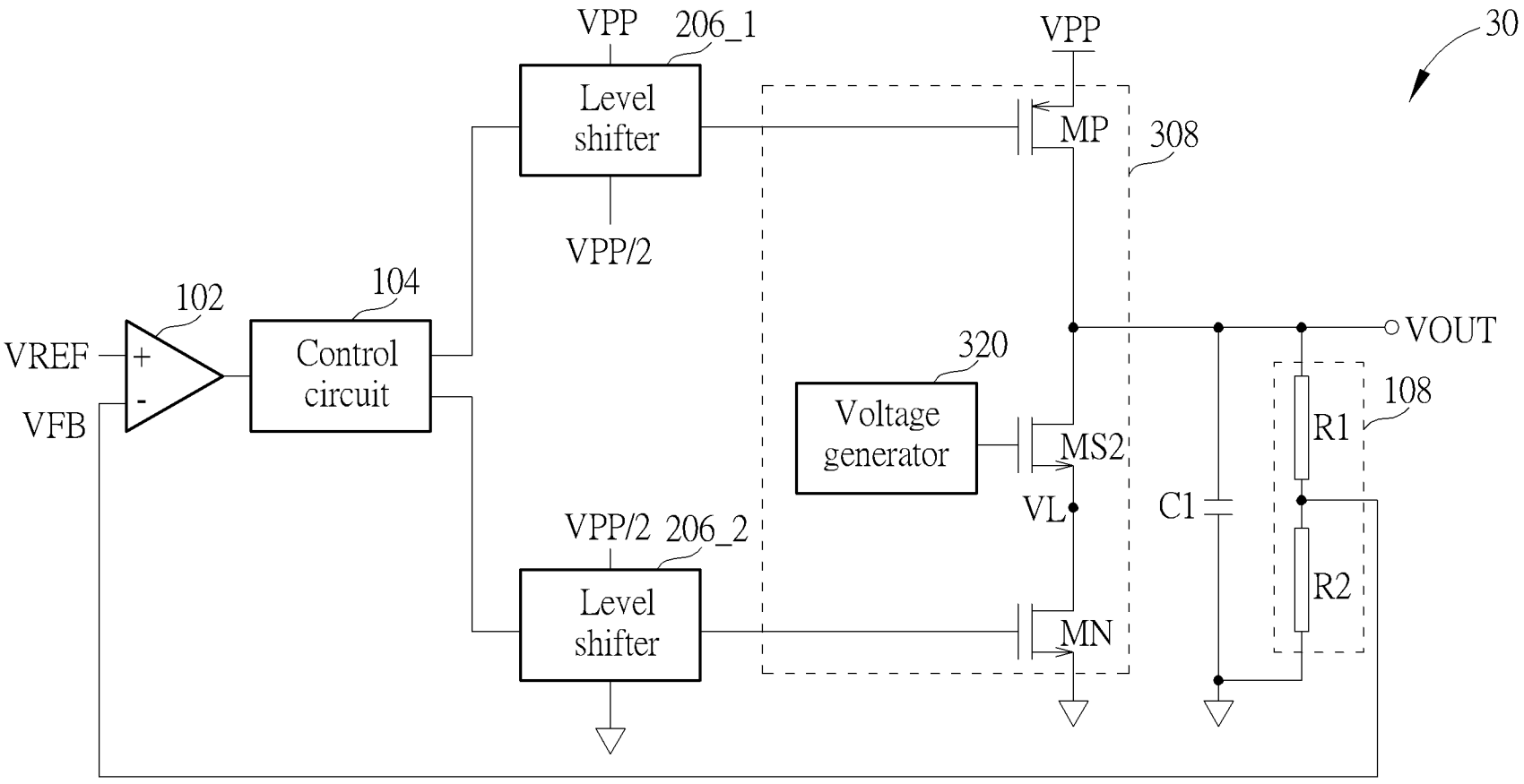
FIG. 3 is a schematic diagram of another voltage regulator according to an embodiment of the present invention.

It should also be noted that the circuit structure of the voltage regulator 20 is one of various embodiments of the present invention. Please refer to FIG. 3, which is a schematic diagram of another voltage regulator 30 according to an embodiment of the present invention. The circuit structure of the voltage regulator 30 is similar to the circuit structure of the voltage regulator 20, so circuit elements and signals with similar functions are denoted by the same symbols. The voltage regulator 30 is different from the voltage regulator 20 in that, the stack transistor MS2 in the output stage circuit 308 of the voltage regulator 30 is coupled between the low-side transistor MN and the output terminal of the voltage regulator 30, and that the stack transistor MS2 receives agate control signal from a voltage generator 320. More specifically, the stack transistor MS2 is an NMOS transistor. As for the stack transistor MS2, the drain terminal is coupled to the output terminal of the voltage regulator 30, the source terminal is coupled to the low-side output transistor MN, and the gate terminal is coupled to the voltage generator 320.

With the implementation of the stack transistor MS2, the voltage VL may be pushed to a lower value even if the output voltage VOUT is higher. This clamps the drain-to-source voltage of the output transistor MN to be within its withstand voltage, i.e., the withstand voltage of the middle voltage device, so as to prevent overstress appearing on the output transistor MN. In addition, the voltage generator 320 may output a proper gate control voltage to the stack transistor MS2, to turn on the stack transistor MS2 and allow the drain-to-source voltage of the stack transistor MS2 to be within its withstand voltage, so as to prevent overstress appearing on the stack transistor MS2. The detailed implementations and operations of the stack transistor MS2 and the voltage generator 320 are similar to those of the stack transistor MS1 and the voltage generator 220 shown in FIG. 2, and will be omitted herein.

As mentioned above, the stack transistor MS1 may prevent the overstress problem when the output voltage VOUT tends to a lower value. This extends the output voltage range of the voltage regulator 20 by realizing lower output voltages without the usage of high voltage devices. Similarly, the stack transistor MS2 may prevent the overstress problem when the output voltage VOUT tends to a higher value. This extends the output voltage range of the voltage regulator 30 by realize higher output voltages without the usage of high voltage devices. In a further embodiment, both the stack transistors MS1 and MS2 are implemented, as the voltage regulator 40 shown in FIG. 4. Therefore, a wide range of output voltage may be achieved with the usage of only middle voltage devices in the level shifters and the output stage circuit.

Figure 4:
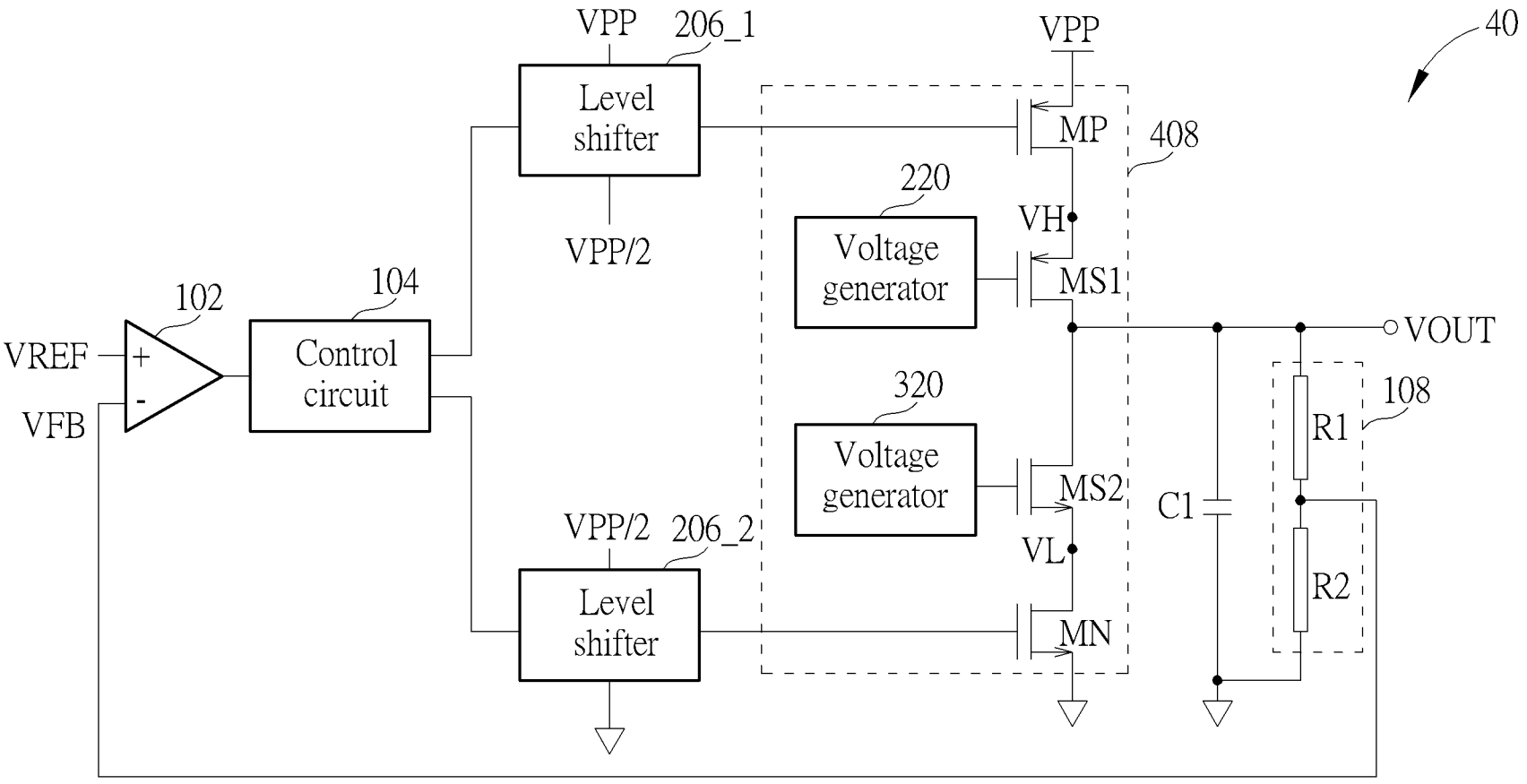
FIG. 4 is a schematic diagram of a further voltage regulator according to an embodiment of the present invention.

In an embodiment, the power supply voltage VPP may be 13.5V, a high supply voltage in the system. The circuit elements in the voltage regulator of the present invention may be implemented with middle voltage devices having a withstand voltage approximately equal to 7V, instead of high voltage devices capable of withstanding the 13.5V high voltage. In such a situation, the output voltage range of the voltage regulator may be from 3V to 10V. As a result, the voltage regulator may achieve a wider output voltage range without the usage of high voltage process. In addition, since no high voltage process and devices are used in the voltage regulator, the chip area and circuit costs may be saved. For example, in the voltage regulator 40 as shown in FIG. 4, the amplifier 102 and the control block 104 are implemented with low voltage devices, and the level shifters 206_1 and 206_2 and the output stage circuit 408 are implemented with middle voltage devices, where the high voltage process and devices are omitted.

Please note that the present invention aims at providing an output stage circuit and a related voltage regulator having a wide output voltage range without the usage of high voltage devices. Those skilled in the art may make modifications and alternations accordingly. For example, the abovementioned voltage values of the power supply voltage VPP and the withstand voltages of the high voltage devices and the middle voltage devices are merely an example intended to better illustrate the embodiments, and may not become a limitation on the scope of the present invention. In addition, in the above embodiments, the proposed output stage circuits are realized in a push-pull voltage regulator. In another embodiment, the output stage circuits of the present invention may also be applicable to other types of voltage regulators.

Figure 5:
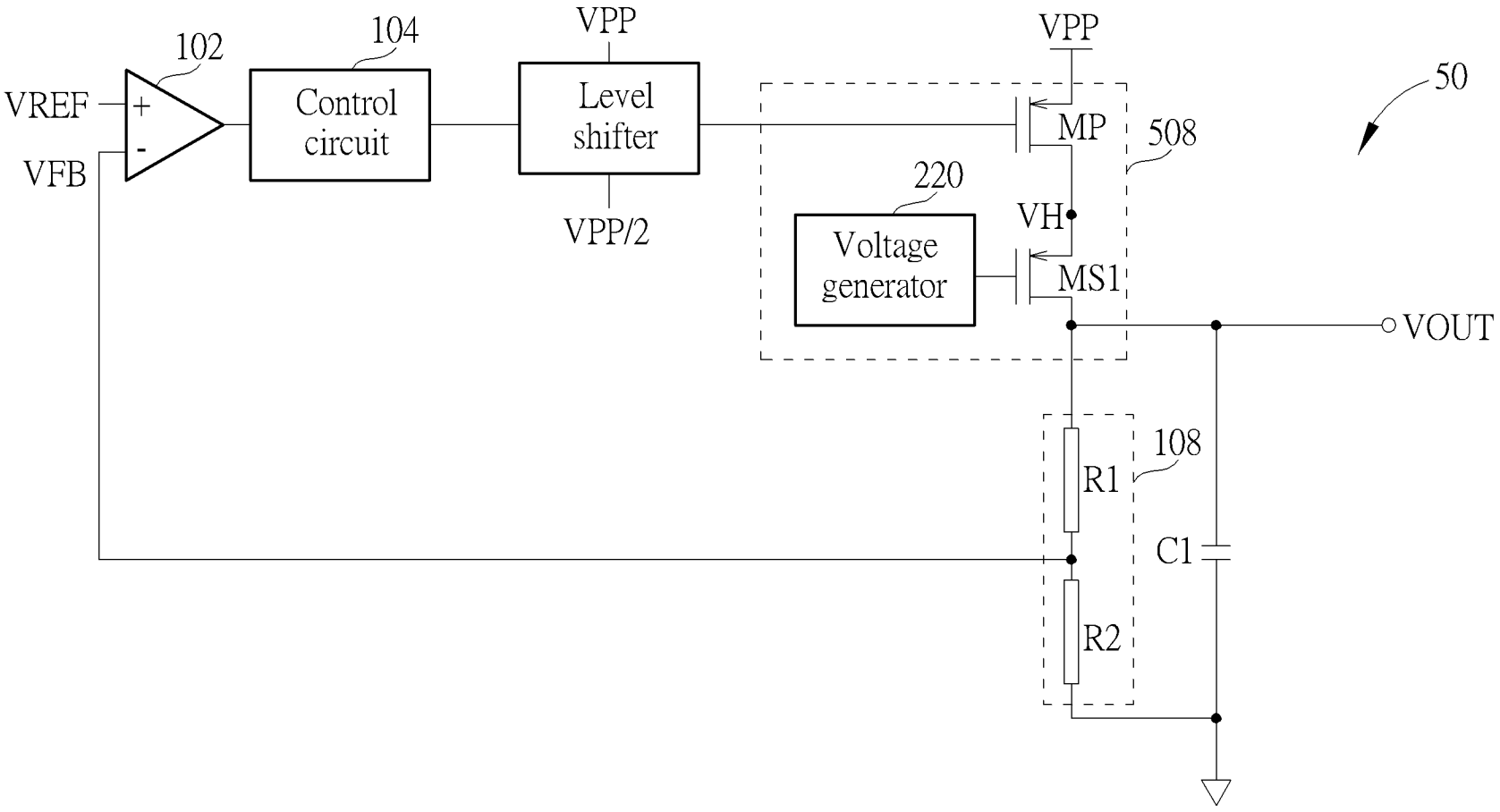
FIG. 5 illustrates a voltage regulator according to an embodiment of the present invention.
Figure 6:
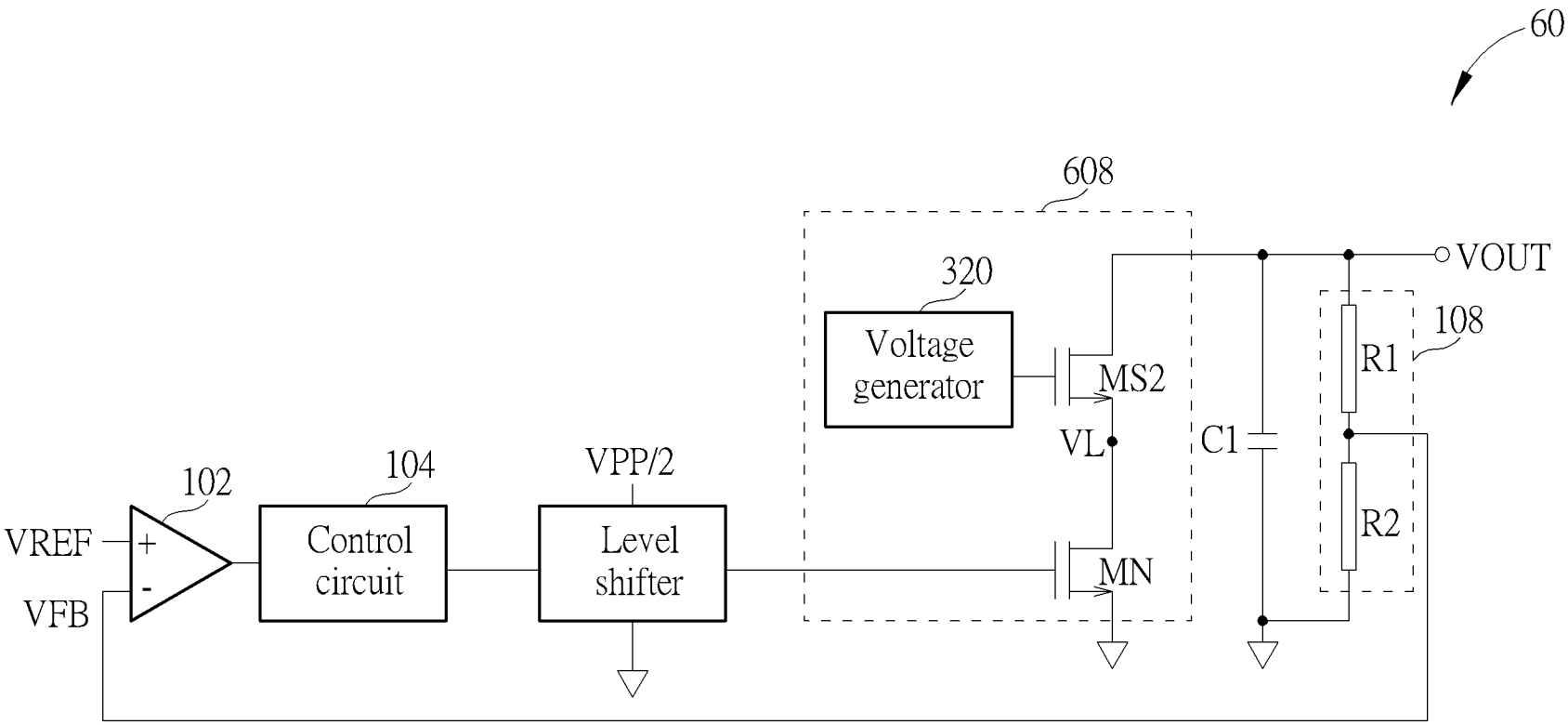
FIG. 6 illustrates another voltage regulator according to an embodiment of the present invention.

FIG. 5 illustrates a voltage regulator 50 according to an embodiment of the present invention. The voltage regulator 50 is a low dropout (LDO) regulator providing current source rather than the push-pull regulation function. In the voltage regulator 50, the output stage circuit 508 only includes one output transistor MP at the high side but no low-side transistor. The output transistor MP is connected to the stack transistor MS1 receiving a proper gate control voltage from the voltage generator 220, so as to prevent the overstress problem. FIG. 6 illustrates another voltage regulator 60 according to an embodiment of the present invention. The voltage regulator 60 is an LDO regulator providing current sink rather than the push-pull regulation function. In the voltage regulator 60, the output stage circuit 608 only includes one output transistor MN at the low side but no high-side transistor. The output transistor MN is connected to the stack transistor MS2 receiving a proper gate control voltage from the voltage generator 320, so as to prevent the overstress problem. Other circuit elements in the voltage regulators 50 and 60 are similar to those described in the above embodiments, and thus denoted by the same symbols. The detailed implementations and operations of the voltage regulators 50 and 60 are similar to those of the voltage regulators 20 and 30, and will not be narrated herein.

To sum up, the present invention provides a voltage regulator capable of realizing a large output voltage range with the usage of middle voltage devices and/or low voltage devices. In the voltage regulator of the present invention, the output stage circuit includes a stack transistor coupled between the output transistor and the output terminal of the voltage regulator. The stack transistor clamps the drain-to-source voltage of the output transistor, and is well controlled by receiving a proper gate control voltage from a voltage generator. Therefore, the output stage circuit with a high power supply voltage may be implemented with middle voltage devices only, and the overstress problem may be prevented by disposing the stack transistor. As a result, the output voltage range of the voltage regulator may be extended without the usage of any high voltage devices, so as to save the chip area and circuit costs.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An output stage circuit of a voltage regulator, the output stage circuit coupled to a control circuit of the voltage regulator and comprising:

a first output transistor, coupled to the control circuit and configured to receive a gate control signal from the control circuit according to an output voltage of the voltage regulator;

a first voltage generator; and a first stack transistor, coupled between the first output transistor and an output terminal of the voltage regulator, the first stack transistor comprising:

a drain terminal, coupled to the output terminal of the voltage regulator;

a source terminal, coupled to the first output transistor; and a gate terminal, coupled to the first voltage generator;

wherein the first voltage generator is configured to output a control voltage to the first stack transistor according to the output voltage of the voltage regulator.

2. The output stage circuit of claim 1, further comprising:

a second output transistor, coupled to the output terminal of the voltage regulator.

3. The output stage circuit of claim 2, further comprising:

a second voltage generator; and a second stack transistor, coupled between the second output transistor and the output terminal of the voltage regulator, the second stack transistor comprising:

a first terminal, coupled to the output terminal of the voltage regulator;

a second terminal, coupled to the second output transistor; and a third terminal, coupled to the second voltage generator.

4. The output stage circuit of claim 2, wherein the first output transistor is coupled between the first stack transistor and a power supply terminal, and the second output transistor is coupled between the output terminal of the voltage regulator and a ground terminal.

5. The output stage circuit of claim 2, wherein the first output transistor is coupled between the first stack transistor and a ground terminal, and the second output transistor is coupled between the output terminal of the voltage regulator and a power supply terminal.

6. The output stage circuit of claim 1, wherein the first output transistor and the first stack transistor are middle voltage devices.

7. The output stage circuit of claim 6, wherein the output stage circuit operates in a power supply voltage greater than a withstand voltage of the middle voltage devices.

8. The output stage circuit of claim 1, wherein the control voltage is selected from a plurality of candidate voltages according to the output voltage of the voltage regulator.

9. The output stage circuit of claim 8, wherein a first candidate voltage with a higher value is selected as the control voltage when the output voltage of the voltage regulator is higher, and a second candidate voltage with a lower value is selected as the control voltage when the output voltage of the voltage regulator is lower.

10. The output stage circuit of claim 1, wherein the first stack transistor clamps a drain-to-source voltage of the first output transistor to be within a withstand voltage of the first output transistor.

11. A voltage regulator, comprising:

an amplifier;

a control circuit, coupled to the amplifier;

a level shifter, coupled to the control circuit; and an output stage circuit, coupled to the level shifter and the control circuit, the output stage circuit comprising:

a first output transistor, coupled to the control circuit and configured to receive a gate control signal from the control circuit according to an output voltage of the voltage regulator;

a first voltage generator; and a first stack transistor, coupled between the first output transistor and an output terminal of the voltage regulator, the first stack transistor comprising:

a drain terminal, coupled to the output terminal of the voltage regulator;

a source terminal, coupled to the first output transistor; and a gate terminal, coupled to the first voltage generator;

wherein the first voltage generator is configured to output a control voltage to the first stack transistor according to the output voltage of the voltage regulator.

12. The voltage regulator of claim 11, wherein the output stage circuit further comprises:

a second output transistor, coupled to the output terminal of the voltage regulator.

13. The voltage regulator of claim 12, wherein the output stage circuit further comprises:

a second voltage generator; and a second stack transistor, coupled between the second output transistor and the output terminal of the voltage regulator, the second stack transistor comprising:

a first terminal, coupled to the output terminal of the voltage regulator;

a second terminal, coupled to the second output transistor; and a third terminal, coupled to the second voltage generator.

14. The voltage regulator of claim 12, wherein the first output transistor is coupled between the first stack transistor and a power supply terminal, and the second output transistor is coupled between the output terminal of the voltage regulator and a ground terminal.

15. The voltage regulator of claim 12, wherein the first output transistor is coupled between the first stack transistor and a ground terminal, and the second output transistor is coupled between the output terminal of the voltage regulator and a power supply terminal.

16. The voltage regulator of claim 11, wherein the first output transistor and the first stack transistor are middle voltage devices.

17. The voltage regulator of claim 16, wherein the output stage circuit operates in a power supply voltage greater than a withstand voltage of the middle voltage devices.

18. The voltage regulator of claim 11, wherein the control voltage is selected from a plurality of candidate voltages according to the output voltage of the voltage regulator.

19. The voltage regulator of claim 18, wherein a first candidate voltage with a higher value is selected as the control voltage when the output voltage of the voltage regulator is higher, and a second candidate voltage with a lower value is selected as the control voltage when the output voltage of the voltage regulator is lower.

20. The voltage regulator of claim 11, wherein the first stack transistor clamps a drain-to-source voltage of the first output transistor to be within a withstand voltage of the first output transistor.

21. An output stage circuit of a push-pull voltage regulator, the output stage circuit coupled to a control circuit of the push-pull voltage regulator and comprising:

a high-side output transistor, coupled to the control circuit and configured to receive a gate control signal from the control circuit according to an output voltage of the push-pull voltage regulator;

a low-side output transistor;

a first voltage generator; and a first stack transistor, coupled between the high-side output transistor and an output terminal of the push-pull voltage regulator, the first stack transistor comprising:

a drain terminal, coupled to the output terminal of the push-pull voltage regulator;

a source terminal, coupled to the high-side output transistor; and a gate terminal, coupled to the first voltage generator;

wherein the first voltage generator is configured to output a control voltage to the first stack transistor according to the output voltage of the push-pull voltage regulator.

22. The output stage circuit of claim 21, further comprising:

a second voltage generator; and a second stack transistor, coupled between the low-side output transistor and the output terminal of the push-pull voltage regulator, the second stack transistor comprising:

a first terminal, coupled to the output terminal of the push-pull voltage regulator;

a second terminal, coupled to the low-side output transistor; and a third terminal, coupled to the second voltage generator.

23. An output stage circuit of a push-pull voltage regulator, the output stage circuit coupled to a control circuit of the push-pull voltage regulator and comprising:

a high-side output transistor;

a low-side output transistor, coupled to the control circuit and configured to receive a gate control signal from the control circuit according to an output voltage of the push-pull voltage regulator;

a first voltage generator; and a first stack transistor, coupled between the low-side output transistor and an output terminal of the push-pull voltage regulator, the first stack transistor comprising:

a drain terminal, coupled to the output terminal of the push-pull voltage regulator;

a source terminal, coupled to the low-side output transistor; and a gate terminal, coupled to the first voltage generator;

wherein the first voltage generator is configured to output a control voltage to the first stack transistor according to the output voltage of the push-pull voltage regulator.

24. The output stage circuit of claim 23, further comprising:

a second voltage generator; and a second stack transistor, coupled between the high-side output transistor and the output terminal of the push-pull voltage regulator, the second stack transistor comprising:

a first terminal, coupled to the output terminal of the push-pull voltage regulator;

a second terminal, coupled to the high-side output transistor; and a third terminal, coupled to the second voltage generator.

* * * * *